United States Patent [19]
Long
[11] 4,318,255
[45] Mar. 9, 1982

[54] MODULAR INTERIOR STORM WINDOW AND HEAT TRAP

[76] Inventor: Harry L. Long, 1211 Cherrystone, Norman, Okla. 73069

[21] Appl. No.: 122,884

[22] Filed: Feb. 20, 1980

[51] Int. Cl.³ ..... E06B 3/26
[52] U.S. Cl. ..... 52/202; 52/632; 160/374
[58] Field of Search ..... 52/202, 203, 632; 160/374

[56] References Cited

U.S. PATENT DOCUMENTS

| | | | |
|---|---|---|---|
| 1,142,311 | 6/1915 | Crandall | 160/374 |
| 1,503,018 | 7/1924 | Beecher | 160/374 |
| 2,624,405 | 1/1953 | Lynch | 160/374 |
| 2,800,957 | 7/1957 | Giglio | 160/374 |
| 2,955,651 | 10/1960 | Replogle | 160/374 |
| 3,004,321 | 10/1961 | Pulliam | 52/632 |

FOREIGN PATENT DOCUMENTS

| | | | |
|---|---|---|---|
| 142236 | 6/1951 | Australia | 52/632 |
| 461159 | 11/1949 | Canada | 52/202 |
| 453694 | 12/1949 | Italy | 52/632 |

*Primary Examiner*—James A. Leppink
*Assistant Examiner*—Henry E. Raduazo
*Attorney, Agent, or Firm*—Robert M. Hessin

[57] ABSTRACT

A window insulation device is disclosed for interior installation. The device comprises at least two tubular sections, and at least one male and one female section. The male and female sections are adjustably fitted for tight reception between the window sill and window frame.

6 Claims, 4 Drawing Figures

MODULAR INTERIOR STORM WINDOW AND HEAT TRAP

BACKGROUND OF THE INVENTION

1. Field of the Invention

The invention relates generally to window insulation devices and, more particularly, but not by way of limitation, it relates to an improved manufacture and construction of a modular type of interiorally installed window insulator.

2. Description of the Prior Art

The prior art includes numerous forms of storm window which are intended for permanent insulation over the outer surfaces of window and door ports, cleaning and safety accessibility generally not being a factor considered. There have also been development of various forms of storm window for installation on the interior of a window glazing to provide dead air space adjacent the window for insulation purposes. These interior installations have taken various forms and are installed utilizing many diverse modes of affixure and positioning within the window space. Of particular interest to the teachings of the present invention are a patent to Saucier, which device includes a plurality of removable horizontal panels that may be disposed on the interior of a window opening to provide a dead air space. This invention is directed to a cascade or vertically sliding device utilizing a plurality of horizontal panels which can be positioned in their extremely extended form to cover over the window space interior. There are still other patents of general interest which teach various forms of plastic covering and other easily adaptable framing structures that are placeable over the interior of the window panel frame thereby to provide the requisite dead air space.

SUMMARY OF THE INVENTION

The present invention relates to an improved form of interior storm window construction which provides a double closed-air insulation while also providing recirculation of room conditioned warm air through a more interior dead air space. The device of the present invention consists of a plurality of extendable clear plastic modules of generally rectangular hollow formation, each module consisting of a male and female component that are relatively longitudinally slidable when in operative position to enable adjustment to the requisite height or length of the window being fitted. Thus, the devices may be tightly inserted between the window sill and the top of the window frame as a requisite plurality of modules are utilized to fill out the width of the window frame. Each module when assembled is hollow and provided with end openings sufficient so that room conditioned air can be circulated therethrough if desired.

Therefore, it is an object of the present invention to provide a window insulation device which may be readily installed by the homeowner.

It is also an object of the present invention to provide an improved form of storm window device which may be installed interiorally for low costs and ease of replacement and cleaning.

Finally, it is an object of this invention to provide an effective window insulating and heat trapping device which can be installed without the requirement of fixtures and fasteners or other types of permanent installation assembly.

Other objects and advantages of the invention will be evident from the following detailed description when read in conjunction with the accompanying drawings which illustrate the invention.

BRIEF DESCRIPTION OF THE DRAWINGS

FIG. 3 is a window frame as viewed from the interior with insulation modules installed.

DETAILED DESCRIPTION OF THE INVENTION

Figure 1:
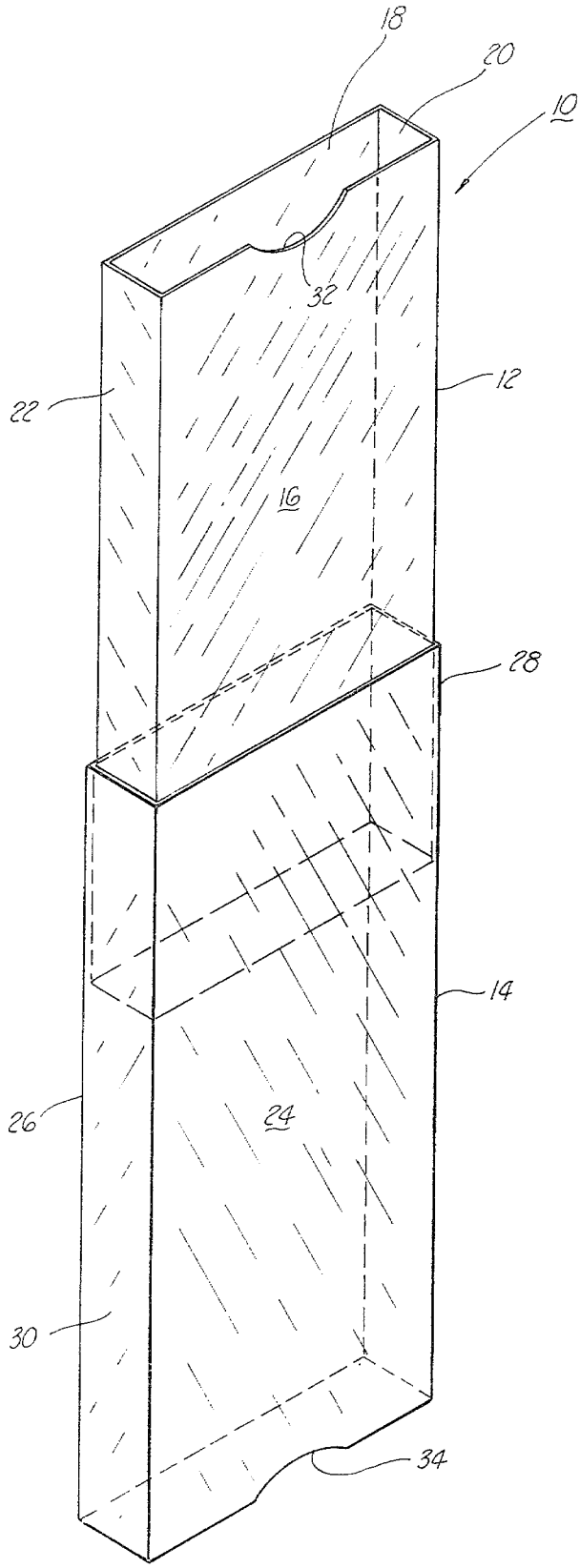
FIG. 1 is a perspective front view of an insulating module, including both male and female module components.

Referring to FIG. 1, an insulative module 10 consists of a male module 12 as it is firmly but slidingly received within a female module 14. The male module 12 is of tubular form having a rectangular cross-section as formed by front panel 16, rear panel 18 and opposite side panels 20 and 22. The female module 14 is similarly formed albeit of slightly larger cross-sectional area, it being formed from front panel 24 and parallel rear panel 26 with opposite side panels 28 and 30. The opposed upper and lower ends of each of male module 12 and female module 14 are entirely open.

The modules 12 and 14 may be unitarily formed as by extrusion process from a suitable plastic, e.g. ABS, etc., preferably a clear plastic similar to the commercially well-known drinking cup quality. The module panels should be of thickness sufficient to insure rigidity. One end of each of the modules 12 and 14 is formed with a cut-out portion which serves to provide a heat convection or chimney effect, as will be further described. Thus, the male module 12 has a semi-circular cut-out 32 formed centrally on one end of front panel 16; and, the female module 14 is formed with a similar cut-out portion 34 on one end of front panel 24.

The insulating module 10 is formed so that male module 12 may be tightly received within female module 14 and secured at a desired extension of length for insertion on a window sill within a window interior to extend to the top frame of the window. The insulative module 10 may be of a standardized size, e.g. ½ to 2 inches thick, about 8 inches wide, and about 2–3 feet in length, so that a plurality of the modules 10 may be inserted within the window opening in side-by-side relationship to provide a double dead air space sealing effect.

Figure 2:
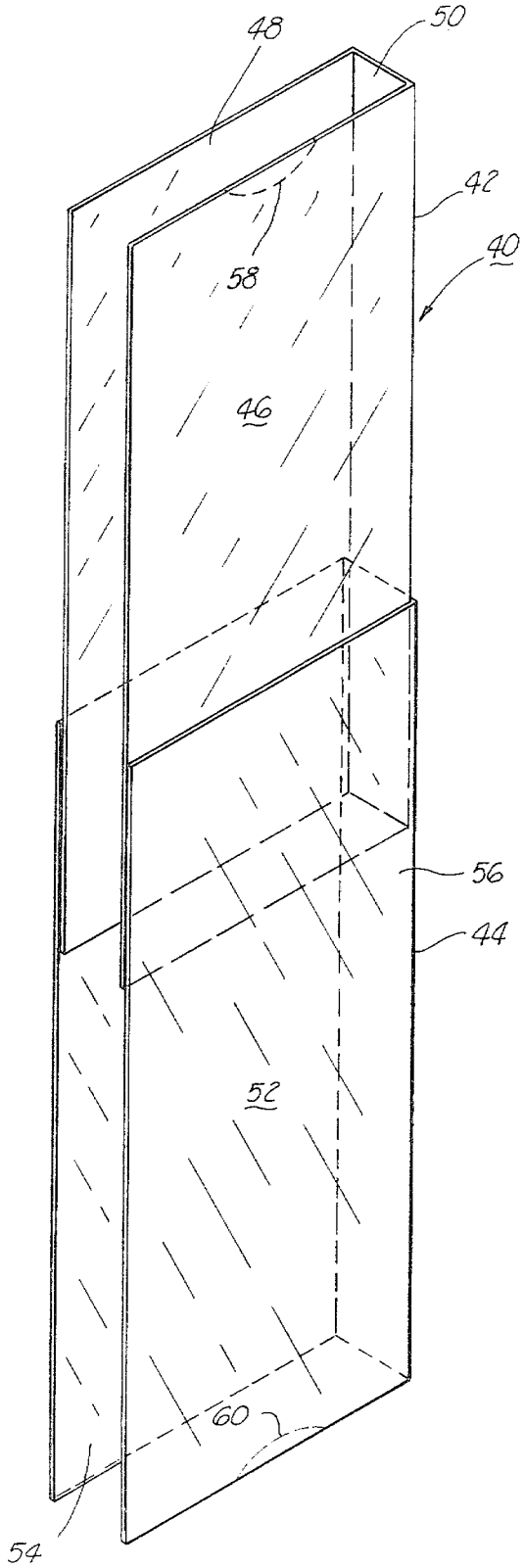
FIG. 2 is a perspective view of a sizing module, including both male and female sizing components.

As shown in FIG. 2, a sizing module 40 may be adjustably inserted at the end spaces of the window opening so that the opening is totally blocked to provide the insulative isolation. The sizing modules 40 consist of similarly unitarily formed male sizing module 42 having similar cross-sectional configuration but slightly less in area so that it is tightly received within a female sizing module 44. The male sizing module 42 is formed by the opposed front and rear panels 46 and 48 as joined by a side panel 50, and the female sizing module 44 is formed by opposed front and rear panels 52 and 54 as joined by a side panel 56. Knockout indentations 58 and 60 are provided on the respective front panels 46 and 52 so that, if desired, the knockouts can be removed to provide vent openings.

Figure 4:
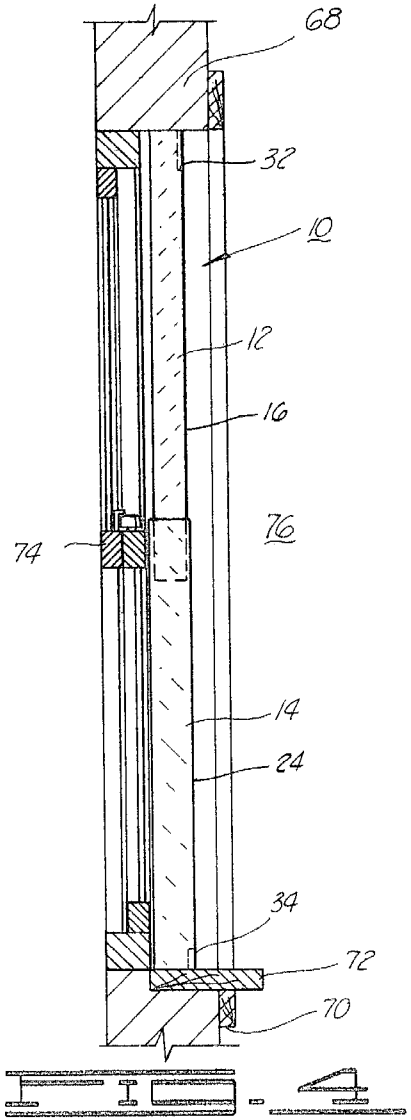
FIG. 4 is a vertical section taken along lines 4—4 of FIG. 3.
Figure 1:
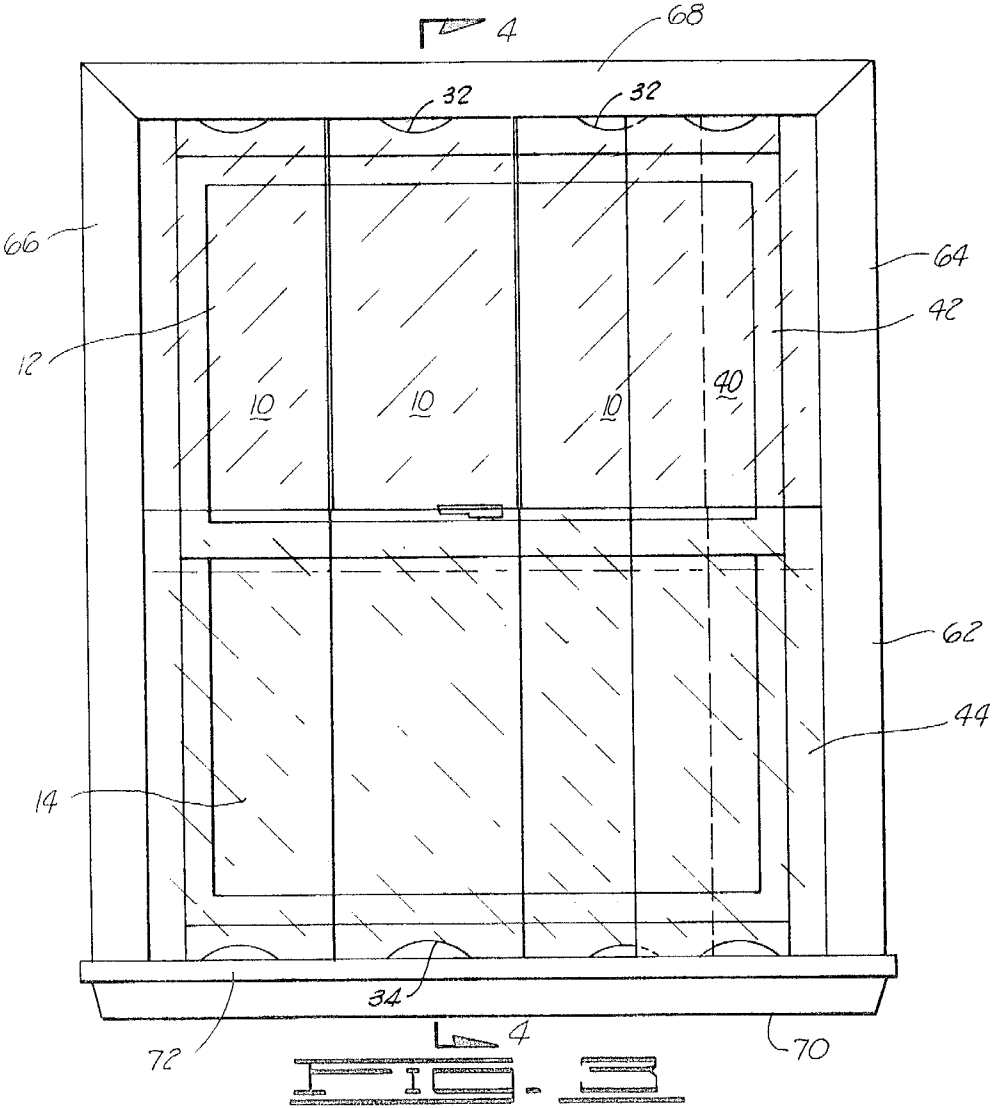

FIGS. 3 and 4 depict a plurality of insulative modules 10 in operative position within a window opening. A plurality of modules 10 and a sizing module 40 are shown in placement within a standard form of window frame 62 having interior side frames 64 and 66 and top frame 68 with lower frame 70 and window sill 72 extending across the bottom. The modules 10 are disposed in tight, serial juxtaposition across window sill 72 and final enclosure is effected by the sizing module 40 as properly placed to isolate the window assembly 74 from the interior 76. The modules may be readily inserted within the window opening and extended to proper height, and if their natural firm interconnection will not hold them, then it is merely necessary to apply a drop of solvent or other household cement to provide the proper modular length and tight fit between the sill and upper frame 68.

The double dead air space provides still further heat control effects. Thus, in cold weather, the plurality of insulative modules 10 may be disposed as shown in FIG. 4 with the respective lower cut-out 34 and upper cut-out 32 directed into the building interior 76. Thus, while the modular insulator provides a double dead air space within exterior window assembly 74, it provides a heat trap and energy return as interior air entering cut-out 34 can be warmed by convection for travel up through the module 10 and release through cut-out 32 back into the interior room. Thus, there is not only provision of a double dead air space but a convection current of warmed air input to interior 76.

In warm weather, insulation is enhanced by simply reversing each of the insulative modules 10 and the sizing module 40 so that the respective upper and lower cut-out portions 32 and 34 are directed outward from interior 76 toward the window pane assembly 74. Here again, there is the provision of double dead air space between interior 76 and the exterior while on sun sides of the building there is a double reflectance surface for reflecting and diffusing sunlight thereby to enhance the cooling effect. The homeowner has the option also to reverse joining ends of modules 10 so that no vent opening will be present on upper and lower ends.

The foregoing discloses an economical energy saver in the form of a modular storm window which can be easily installed by the home handyman or housewife to provide great heating and/or cooling savings. The modular elements are easily inserted within interior window openings with final positioning of a sizing module to fully isolate the window assembly from the building interior. In addition, the modular device provides a double dead air space, rather than the conventional single isolation space, and the particular mode of structure offers other advantages as to air current convection and selected conditions of the radiation, reflection and convection phenomena.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A modular storm window assembly for insertion within the interior of a window frame and sill, comprising:

at least one male tubular module of uniform rectangular cross-section and transparency having first and second open ends;

at least one female tubular module of uniform rectangular cross-section and transparency having first and second open ends and being of a cross-sectional size to tightly receive said male tube within an open end; and whereby the male and female tubular modules can be adjustably fitted for tight reception between the window sill and window frame.

2. A modular storm window assembly as set forth in claim 1 which is further characterized to include:

a plurality of said uniform male and female tubes disposed in serial juxtaposition to enclose the opening of the window frame and sill.

3. A modular storm window assembly as set forth in claim 2 which is further characterized to include:

a uniform male sizing module of rectangular cross-section having first and second open ends and one open side;

a uniform female sizing module of rectangular cross-section having the first and second open ends and one open side, and being of cross-sectional size to tightly receive said male sizing module therein; and whereby the male and female sizing modules can be adjustably fitted between the window frame and sill as well as in envelopment with the aligned open sides disposed slidably over an adjacent tubular module to enclose said opening.

4. A modular storm window as set forth in claim 1 which is further characterized in that:

opposite ends of said male and female tubular modules are formed with a cut-out portion on a similar side of respective ends thereby to provide a convection air flow path through the tubular modules.

5. A modular storm window as set forth in claim 2 which is further characterized in that:

opposite ends of said male and female tubular modules are formed with a cut-out portion on a similar side of respective ends thereby to provide a convection air flow path through the tubular modules.

6. A modular storm window as set forth in claim 3 which is further characterized in that:

opposite ends of said male and female tubular modules are formed with a cut-out portion on a similar side of respective ends thereby to provide a convection air flow path through the tubular modules.

* * * * *